US012276188B2

(12) United States Patent
Agrawal et al.

(10) Patent No.: US 12,276,188 B2
(45) Date of Patent: Apr. 15, 2025

(54) OPTIMIZING DRILLING PARAMETERS FOR CONTROLLING A WELLBORE DRILLING OPERATION

(71) Applicant: Landmark Graphics Corporation, Houston, TX (US)

(72) Inventors: Abhishek Agrawal, Karnataka (IN); Shang Zhang, Fulshear, TX (US); Robello Samuel, Cypress, TX (US)

(73) Assignee: Landmark Graphics Corporation, Houston, TX (US)

( * ) Notice: Subject to any disclaimer, the term of this patent is extended or adjusted under 35 U.S.C. 154(b) by 373 days.

(21) Appl. No.: 17/840,314

(22) Filed: Jun. 14, 2022

(65) Prior Publication Data

US 2023/0399936 A1 Dec. 14, 2023

(51) Int. Cl.
*E21B 44/00* (2006.01)

(52) U.S. Cl.
CPC ..... *E21B 44/005* (2013.01); *E21B 2200/22* (2020.05)

(58) Field of Classification Search
CPC ..... E21B 44/005; E21B 2200/22; E21B 44/00
See application file for complete search history.

(56) References Cited

U.S. PATENT DOCUMENTS

| | | | | |
|---|---|---|---|---|
| 2004/0256152 | A1 | 12/2004 | Dashevskiy et al. | |
| 2007/0284147 | A1 | 12/2007 | Moran | |
| 2015/0014058 | A1 | 1/2015 | Wassell et al. | |
| 2016/0054729 | A1* | 2/2016 | Payette | E21B 44/04 700/275 |
| 2019/0048704 | A1* | 2/2019 | Kumaran | E21B 44/02 |
| 2021/0062634 | A1 | 3/2021 | Madasu et al. | |
| 2023/0407738 | A1* | 12/2023 | Groover | E21B 47/095 |

FOREIGN PATENT DOCUMENTS

EP 2872738 B1 8/2019

OTHER PUBLICATIONS

International Search Report and Written Opinion, PCT/US2022/033578, Mar. 9, 2023, 9 pages.

* cited by examiner

*Primary Examiner* — Christopher W Carter
(74) *Attorney, Agent, or Firm* — Kilpatrick Townsend & Stockton LLP

(57) ABSTRACT

A system can receive input data indicating a current state of a wellbore drilling operation. The system can determine, by a set of software applications, constraints associated with the wellbore drilling operation. The system can optimize, by an optimization model and using the input data, a drilling parameter subject to the constraints associated with the wellbore drilling operation. The system can output the optimized drilling parameter for controlling the wellbore drilling operation.

17 Claims, 5 Drawing Sheets

OPTIMIZING DRILLING PARAMETERS FOR CONTROLLING A WELLBORE DRILLING OPERATION

TECHNICAL FIELD

The present disclosure relates generally to wellbore drilling operations and, more particularly (although not necessarily exclusively), to optimizing drilling parameters for controlling a wellbore drilling operation.

BACKGROUND

A wellbore can be formed into a subterranean formation for extracting various material such as oil, gas, or water. The wellbore can be formed via one or more wellbore drilling operations. The wellbore drilling operations can be controlled by drilling parameters. Examples of drilling parameters can include a weight applied to a drill bit that is drilling the wellbore, a rate at which the drill bit is rotating, etc. Values that are selected for the drilling parameters can affect the stability of the wellbore drilling operation. But, selecting optimal values that can improve the stability of the wellbore drilling operation can be difficult.

DETAILED DESCRIPTION

Figure 1:
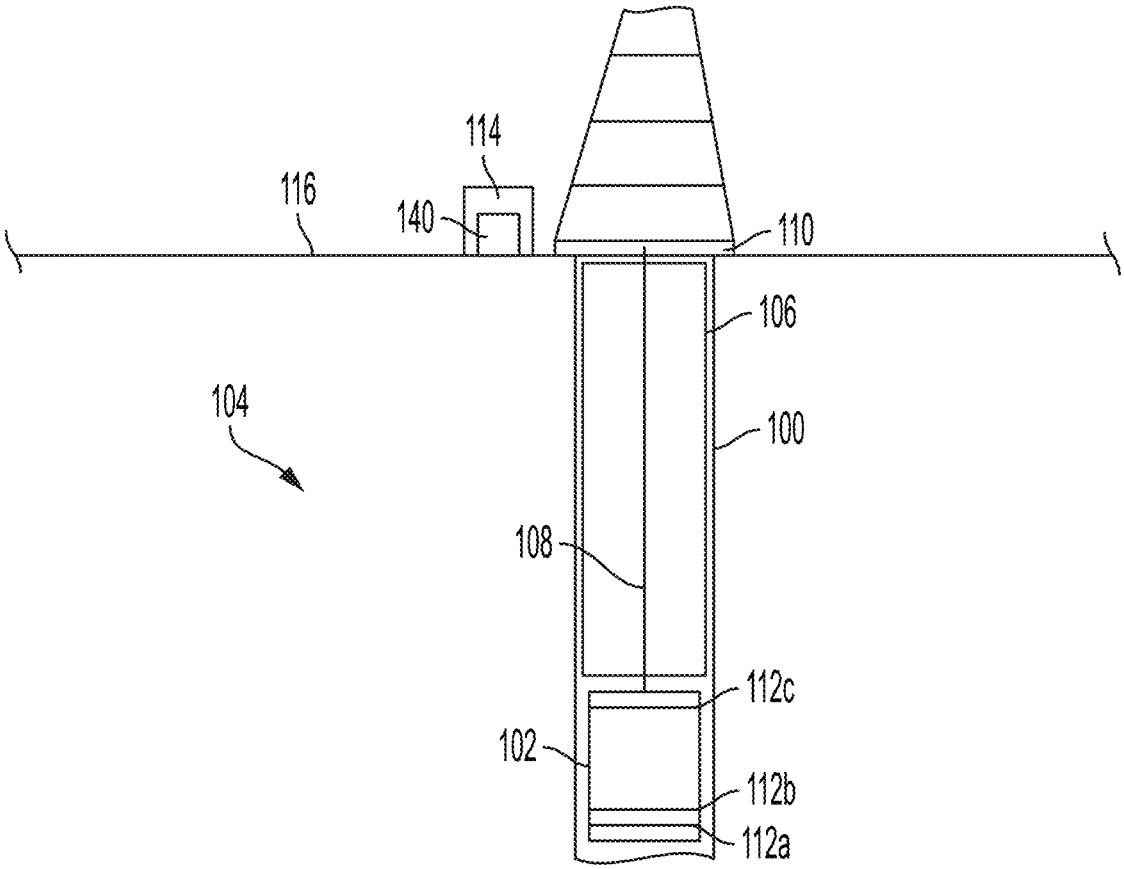
FIG. 1 is a schematic view of a well system according to one example of the present disclosure.

Certain aspects and features of the present disclosure relate to optimizing drilling parameters using an optimization model subject to constraints for controlling a wellbore drilling operation. In some examples, the drilling parameters may include a rate of penetration (ROP) that can indicate how quickly a drill bit of a wellbore drilling operation penetrates the subterranean formation for forming the wellbore. The drilling parameters may also include a weight-on-bit (WOB), a flow rate, a number of rotations of the drill bit per minute (RPM), etc. The optimization model can be used to optimize the drilling parameters with respect to certain constraints associated with the wellbore drilling operation. For example, the optimization model can receive constraints, such as minimum and maximum values, or stable value ranges, for the drilling parameters, and can optimize the drilling parameters subject to the constraints. For example, the optimization model can accept input data, which can include historical data associated with the wellbore drilling operation, user-input drilling parameters, and a real-time data feed from the wellbore drilling operation. The optimization model can, using the input data, output the optimal drilling parameters such as an optimal weight-on-bit, an optimal rate of penetration, and an optimal number of rotations of the drill bit per minute. The optimal drilling parameters can be used to control the wellbore drilling operation. For example, drilling parameters presently used for the wellbore drilling operation can be adjusted to match the optimal drilling parameters output by the optimization model.

During a drilling operation that can form a wellbore, drilling parameters can be used to control the drilling operation. Some values for the drilling parameters can cause issues for the drilling operation. For example, operating the drill bit with sub-optimal drilling parameters can cause instability in the wellbore. For example, the instability of the wellbore may cause a collapse in the wellbore. In some cases, the instability can result in excessive sloughing from the wellbore wall, which can cause the drill pipe to be stuck in the wellbore. The instability can also lead to an unintentional hydraulic fracturing of the subterranean formation.

Optimizing the drilling parameters can improve a stability of the drilling operation. For example, optimized drilling parameters, and the stable drilling operation that results from optimized drilling parameters, may facilitate forming wellbores with higher stability. Improving wellbore stability can prevent undesirable drilling events from occurring during the wellbore drilling operation. For example, a wellbore with increased stability due to the optimized drilling parameters may be less prone to collapse, stuck-drill pipes, and unintentional hydraulic fracturing of the subterranean formation. Preventing undesirable drilling events from occurring during the wellbore drilling operation by optimizing the drilling parameters can prevent unnecessary uses of resources and delays associated with the wellbore drilling operation.

In some examples, a computing device can optimize and output an optimal drilling parameter for controlling the wellbore drilling operation. Controlling the wellbore drilling operation can include issuing a command to implement the optimal drilling parameter. The command can adjust surface controls for the drilling operation, can be transmitted to a well tool, and the like. For example, the well tool can be a downhole tool. In some examples, the drilling operation can include an automated drilling rig that can operate in an autonomous mode. The automated drilling rig can receive and implement the optimal drilling parameter to automatically control the drilling operation (e.g., without requiring user input).

In some examples, the optimization model can receive input data. The input data can indicate a current state of the wellbore drilling operation. For example, the input data can include a current value of the drilling parameter, historical data associated with the wellbore drilling operation, and log data associated with the wellbore drilling operation. Other suitable data can be used as input. For example, the log data can be transmitted to the computing device substantially contemporaneous to optimizing the drilling parameter. The optimization model can include an objective function that can be minimized or maximized to determine the optimal drilling parameter subject to one or more constraints.

In some examples, the optimization model can be used in conjunction with a set of software applications. The software applications can determine constraints associated with the wellbore drilling operation. In some examples, the software applications can include one or more engineering models or micro-services for determining the constraints. Examples of constraints can include minimum or maximum values that can be associated with the drilling parameter. For example, the optimization engine can, using the input data, determine the optimal drilling parameter. The computing device can use the optimal drilling parameter to adjust the drilling parameters of the wellbore drilling operation. For example, the ROP of the drill bit used in the drilling operation may be adjusted to match an optimal ROP.

The computing device can display the current drilling parameters and the optimal drilling parameters on a graphical user interface. For example, the graphical user interface can include a set of interactive sliders such that each slider can correspond to one of the drilling parameters. Each slider can include a minimum acceptable value of the drilling parameter and a maximum acceptable value of the drilling parameter. The slider can display a current value for each drilling parameter and an optimal value for each drilling parameter. A user can manually adjust the slider, or the computing device can adjust the slider automatically. The graphical user interface can additionally include a plot that can depict constraints that can be associated with the drilling parameters. The constraints may form a stable region of acceptable values for the drilling parameters. In some examples, the plot of constraints can be, include, or otherwise be included in a wellbore drilling envelope.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic view of a well system according to one example of the present disclosure. A wellbore 100 of the well system can be formed in a subterranean formation 104 or other suitable formation (e.g., sub-oceanic, etc.). The wellbore 100 can include a casing 106 or other suitable components such as a tubing string, a workstring, etc. for accessing the wellbore 100 for extracting produced material, such as hydrocarbon material, from the wellbore 100. The wellbore tool 102 can be positioned in the wellbore 100 via a string 108 or any other suitable component that can deploy the wellbore tool 102 in the wellbore 100. In some examples, the string 108 can deploy the wellbore tool 102 via a surface component 110 such as a winch or other suitable component that can lower or otherwise deploy the wellbore tool 102 in the wellbore 100. The wellbore tool 102 can include any suitable tool that can perform operations in the wellbore 100. For example, the wellbore tool 102 can include a drill bit for drilling the wellbore 100.

The drill bit can operate according to drilling parameters. For example, the drill bit can be provided drilling parameters, such as RPM, WOB, and the like, for drilling the wellbore 100. A computing device 140 can determine optimal drilling parameters for the drill bit. For example, the computing device 140 can determine an optimal ROP based on optimal drilling parameters such as WOB and RPM. The computing device 140 can use an optimization engine to determine the optimal drilling parameters. The drilling parameters of the drill bit can be adjusted to meet the optimal ROP. The computing device 140 can be positioned above the surface 116. For example, the computing device 140 can be housed in a surface equipment cabin 114, or in other suitable locations with respect to the wellbore 100. The computing device 140 can be communicatively coupled to the wellbore tool 102 for implementing the optimal drilling parameters. In some examples, the computing device 140 can receive live data from a sensor component that can be included in the wellbore tool 102.

Figure 2:
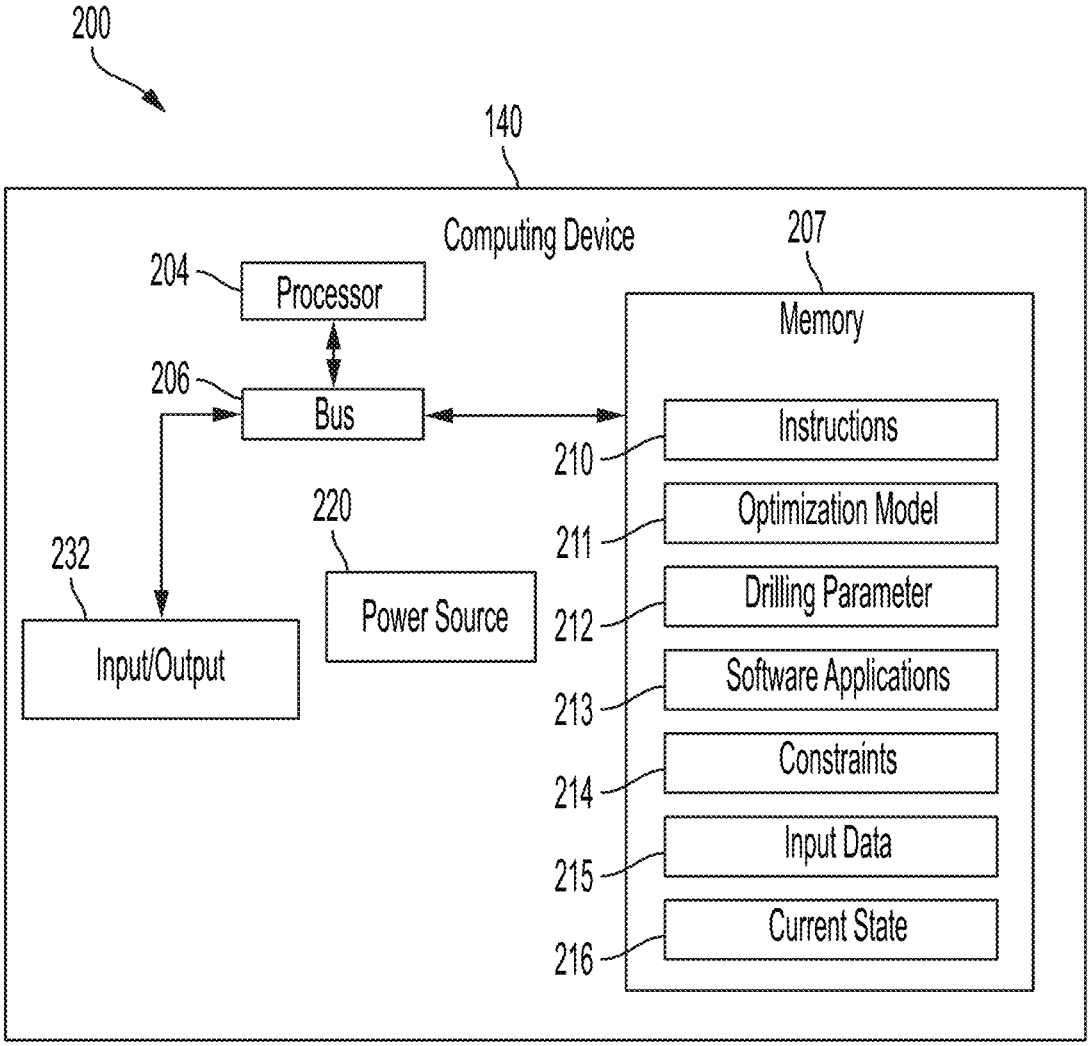
FIG. 2 is block diagram of a computing device for optimizing drilling parameters according to one example of the present disclosure.

FIG. 2 is block diagram of a computing system 200 for optimizing drilling parameters according to one example of the present disclosure. The components shown in FIG. 2, such as the processor 204, memory 207, power source 220, communications device 201, and the like may be integrated into a single structure such as within a single housing of a computing device 140. Alternatively, the components shown in FIG. 2 can be distributed from one another and in electrical communication with each other.

The computing device 140 can include a processor 204, a memory 207, and a bus 206. The processor 204 can execute one or more operations for determining optimal drilling parameters using one or more optimization models subject to one or more constraints. The processor 204 can execute instructions stored in the memory 207 to perform the operations. The processor 204 can include one processing device or multiple processing devices or cores. Non-limiting examples of the processor 204 include a Field-Programmable Gate Array ("FPGA"), an application-specific integrated circuit ("ASIC"), a microprocessor, etc.

The processor 204 can be communicatively coupled to the memory 207 via the bus 206. The non-volatile memory 207 may include any type of memory device that retains stored information when powered off. Non-limiting examples of the memory 207 may include EEPROM, flash memory, or any other type of non-volatile memory. In some examples, at least part of the memory 207 can include a medium from which the processor 204 can read instructions. A computer-readable medium can include electronic, optical, magnetic, or other storage devices capable of providing the processor 204 with computer-readable instructions or other program code. Non-limiting examples of a computer-readable medium include (but are not limited to) magnetic disk(s), memory chip(s), ROM, RAM, an ASIC, a configured processor, optical storage, or any other medium from which a computer processor can read instructions. The instructions can include processor-specific instructions generated by a compiler or an interpreter from code written in any suitable computer-programming language, including, for example, C, C++, C #, Perl, Java, Python, etc.

In some examples, the memory 207 can be a non-transitory computer readable medium and can include computer program instructions 210. For example, the computer program instructions 210 can be executed by the processor 204 for causing the processor 204 to perform various operations.

For example, the processor 204 can receive input data 215 that can indicate a current state 216 of a wellbore drilling operation. For example, the current state 216 of the wellbore drilling operation can include a current value of a drilling parameter 212. The drilling parameter 212 can include ROP, weight-on-bit, a flow rate, RPM, or any combination thereof. The input data 215 can include a case file indicating historical data that can be associated with a wellbore drilling operation, user-input drilling parameters, or a real-time data feed that can be associated with the wellbore drilling operation, or any combination thereof. The processor 204 can execute one or more software applications 213 for determining one or more constraints 214 on the wellbore drilling operation. The software applications 213 can include engineering models for determining the constraints 214. The engineering models can model torque, drag, lateral strain, torsional strain, dull bit grading, or any combination thereof. The software applications 213 can determine a minimum acceptable value and maximum acceptable value for each drilling parameter 212 based on the input data 215. The computing device can feed the constraints 214 and the input data 215 into an optimization model 211. The optimization model 211 can include a neural network model, a fuzzy logic model, a support vector machine, a Monte Carlo simulation, or any combination thereof. The optimization model 211 can determine an optimal value for the drilling parameter 212 based on the input data 215. The optimal value for the drilling parameter 212 may be subject to the constraints 214. The computing device 140 can use the optimal value of the drilling parameter 212 to control the wellbore drilling operation. In some examples, the processor 204 can remotely transmit the optimal value of the drilling parameter 212 to a control system associated with the wellbore drilling operation. For example, the control system can receive and implement the drilling parameter 212 for use in controlling the wellbore drilling operation.

Figure 3:
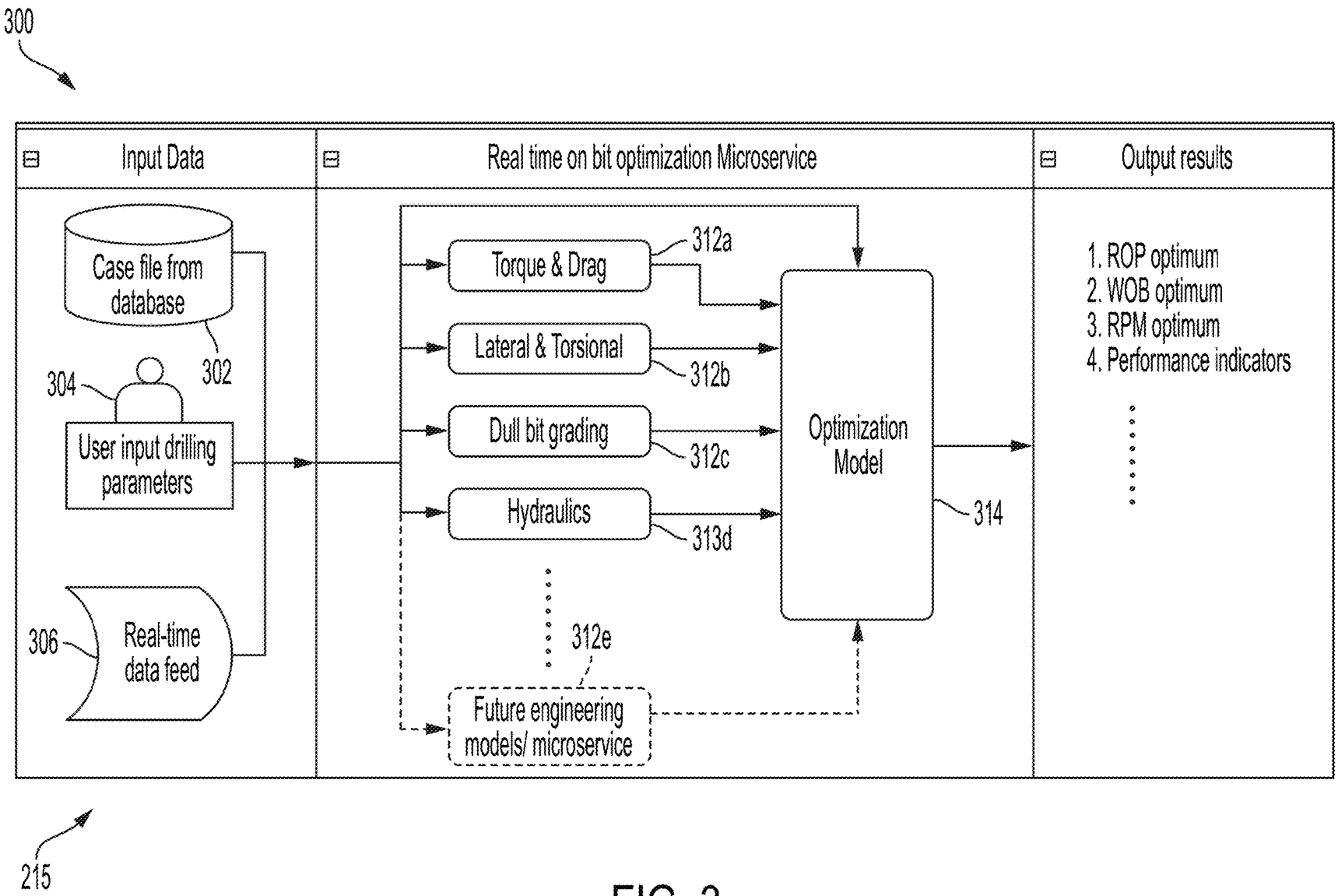
FIG. 3 is a block diagram of a workflow for optimizing drilling parameters according to one example of the present disclosure.

FIG. 3 is a block diagram of a workflow 300 for optimizing drilling parameters according to one example of the present disclosure. As illustrated, the workflow 300 can begin with providing input data 215 to a computing device 140. The input data 215 can include a case file 302 indicating historical data that can be associated with a wellbore drilling operation, user-input drilling parameters 304, and a real-time data feed 306 that can be associated with the wellbore drilling operation. The user-input drilling parameters 304 may include objectives for the drilling operation or other suitable user-input drilling parameters. The real-time data feed 306 may include measured data from the drilling operation or other suitable measured data from the wellbore.

The computing device 140 can transmit the input data 215 to a set of software applications 312*a-e*. In some examples, the software applications 312*a-e* can include one or more micro-services that can each receive the input data 215 and generate one or more constraints for the drilling operation. In some examples, each of the micro-services can include a physical model, such as an engineering model. The engineering models can model torque, drag, lateral strain, torsional strain, dull bit grading, other suitable engineering model for modeling physical attributes of the wellbore 100 or formation, or any suitable combination thereof. For example, a lateral strain micro-service can use the input data 215 to determine an amount of lateral strain or deformation of the subterranean formation surrounding the wellbore. Based on the lateral strain, the lateral strain micro-service can output one or more constraints. For example, the lateral strain micro-service can determine a maximum weight on bit that can be applied to the drill bit to prevent lateral instability. Preventing the lateral instability can help prevent a lateral shear collapse of the wellbore.

In some examples, the software applications 312*a-e* can include a dull bit grading micro-service 312*c*. The dull bit grading micro-service 312*c* can use the input data 215 to determine the performance of the drill bit. Based on the performance of the drill bit, the dull bit grading micro-service 312*c* can output a maximum rate of penetration that can be associated with the wellbore. Other suitable micro-services are possible for generating other suitable constraints for the drilling operation. The computing device 140 can transmit the input data 215 and the output of the software applications 312*a-e* to an optimization model 314.

The optimization model can include a neural network model, a fuzzy logic model, a support vector machine, or a Monte Carlo simulation. For example, the optimization model 314 can include a trained machine-learning model or a trained support vector machine that can map input values to outputs that include constraints for respective drilling parameters. The optimization model 314 can receive the input data 215 and the output or constraints of the software applications 312*a-e* and can generate an optimal drilling parameter. For example, the optimization model 314 can generate an optimal value for ROP, WOB, RPM, other suitable drilling parameters, or any suitable combination thereof. In one particular example, the optimization model 314 can receive a set of inputs that includes the input data 215 and a set of constraints (e.g., whirl, torque and drag, etc.) relating to RPM, and the optimization model 314 can generate an optimal value for the RPM drilling parameter based on the input data 215 and the constraints relating to RPM. In some examples, the optimization model 314 can generate an optimal value for each drilling parameter input into the drill bit used for forming the wellbore 100. The computing device 140 can use the output of the optimization model 314 to automatically control the wellbore drilling operation.

Figure 4:
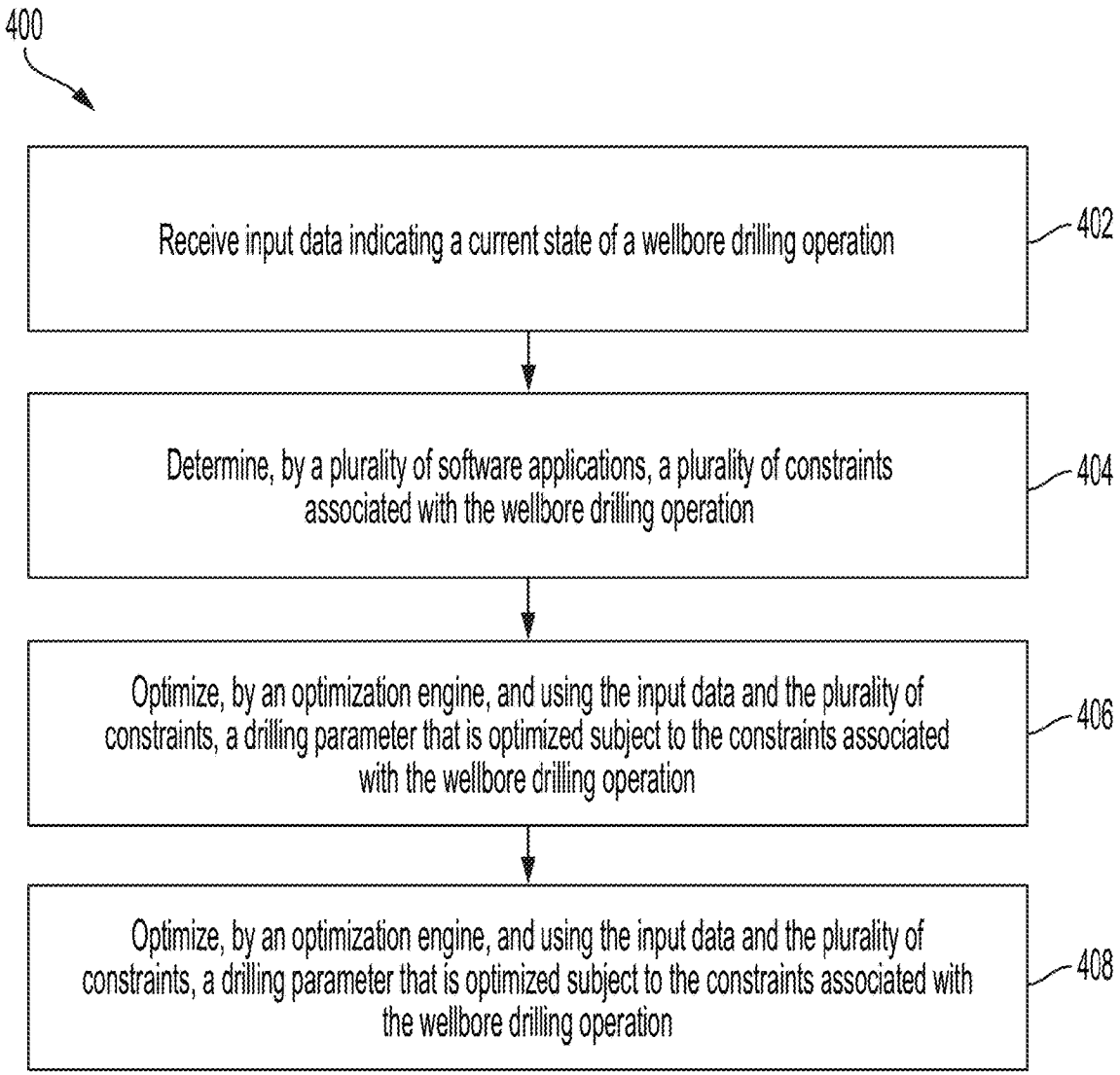
FIG. 4 is a flow chart of a method for optimizing drilling parameters according to one example of the present disclosure.

FIG. 4 is a flowchart of a process 400 for optimizing drilling parameters according to one example of the present disclosure. At block 402, the computing device 140 receives input data 215 indicating a current state of a wellbore drilling operation. The computing device 140 can receive at least a portion of the input data 215 from a sensor component that can be coupled to a wellbore tool used in the wellbore drilling operation. For example, the computing device can receive a CSV file, or other suitable file type, that indicates one or more measurement values and a time value corresponding to the one or more measurement values. The input data 215 can also include a case file associated with the wellbore indicating historical data that can be associated with the wellbore drilling operation, user-input drilling parameters, and other suitable input data 215 that can be used to optimize the drilling parameters.

At block 404, the computing device 140 determines, by a set of software applications 312, a set of constraints associated with the wellbore drilling operation. For example, the constraints can include maximum values, minimum values, or acceptable value ranges of drilling parameters associated with the wellbore drilling operation. Each constraint can be specified to prevent a mode of failure or an inefficiency associated with the wellbore drilling operation. For example, a software application 312 can use the input data 215 to determine a hydro-mechanical specific energy model associated with the wellbore 100. The hydro-mechanical specific energy model can characterize the gravitational energy, hydraulic energy, and torsional energy applied to the wellbore 100. The software application 312 can determine a constraint associated with the hydro-mechanical specific energy, for example, a maximum acceptable hydro-mechanical specific energy to prevent wellbore instability. The computing device 140 can determine the constraints using other suitable software applications 312 such as engineering model for torque and drag, whirl, and the like.

At block 406, the computing device 140 optimizes, by an optimization model 314 and using the input data 215 and the constraints, a drilling parameter subject to the constraints associated with the wellbore drilling operation. For example, based on the hydro-mechanical specific energy, the computing device 140, via the optimization model 314, can determine a maximum acceptable weight that can be applied to the drill bit to prevent the hydro-mechanical specific energy of the wellbore from causing a wellbore instability. In some examples, the computing device 140 can optimize each drilling parameter based on corresponding input data 215 and constraints determined using corresponding or overlapping software applications 312.

In some examples, the computing device 140 can use a combination of models or applications to determine the optimized drilling parameter. The combination of models can include the optimization model 314, a constraint model, and the like for determining the optimized drilling parameter. For example, the computing device 140 can determine, using the software applications 312, one or more maximum and minimum values corresponding to one or more drilling parameters. Subsequently, the computing device 140 can input the maximum and minimum values into a constraint model, which may include a machine-learning model, support vector machine, or the like, to determine a stable or otherwise acceptable range of values of the corresponding drilling parameter and based on the maximum and minimum values. Additionally, the computing device 140 can use the maximum and minimum values and the stable range for the corresponding drilling parameter to determine the optimized value for the corresponding drilling parameter.

At block 408, the computing device 140 outputs the optimized drilling parameter and a performance indicator for controlling the wellbore drilling operation. The performance indicator can include an comparison of a current state of the drilling operation to a state of the drilling operation using the optimal drilling parameter. In some examples, the performance indicator can include a visual indicator (e.g., for displaying on a graphical user interface) that provides the performance indicator for visualizing the current state of the drilling operation compared to an improved or optimal state of the drilling operation. In some examples, the computing device 140 can issue a command to a well tool to adjust the drilling parameters associated with the wellbore drilling operation. For example, the computing device 140 can alter one or more drilling parameters to match or otherwise conform to the optimized drilling parameter output by the optimization model 314.

Figure 5:
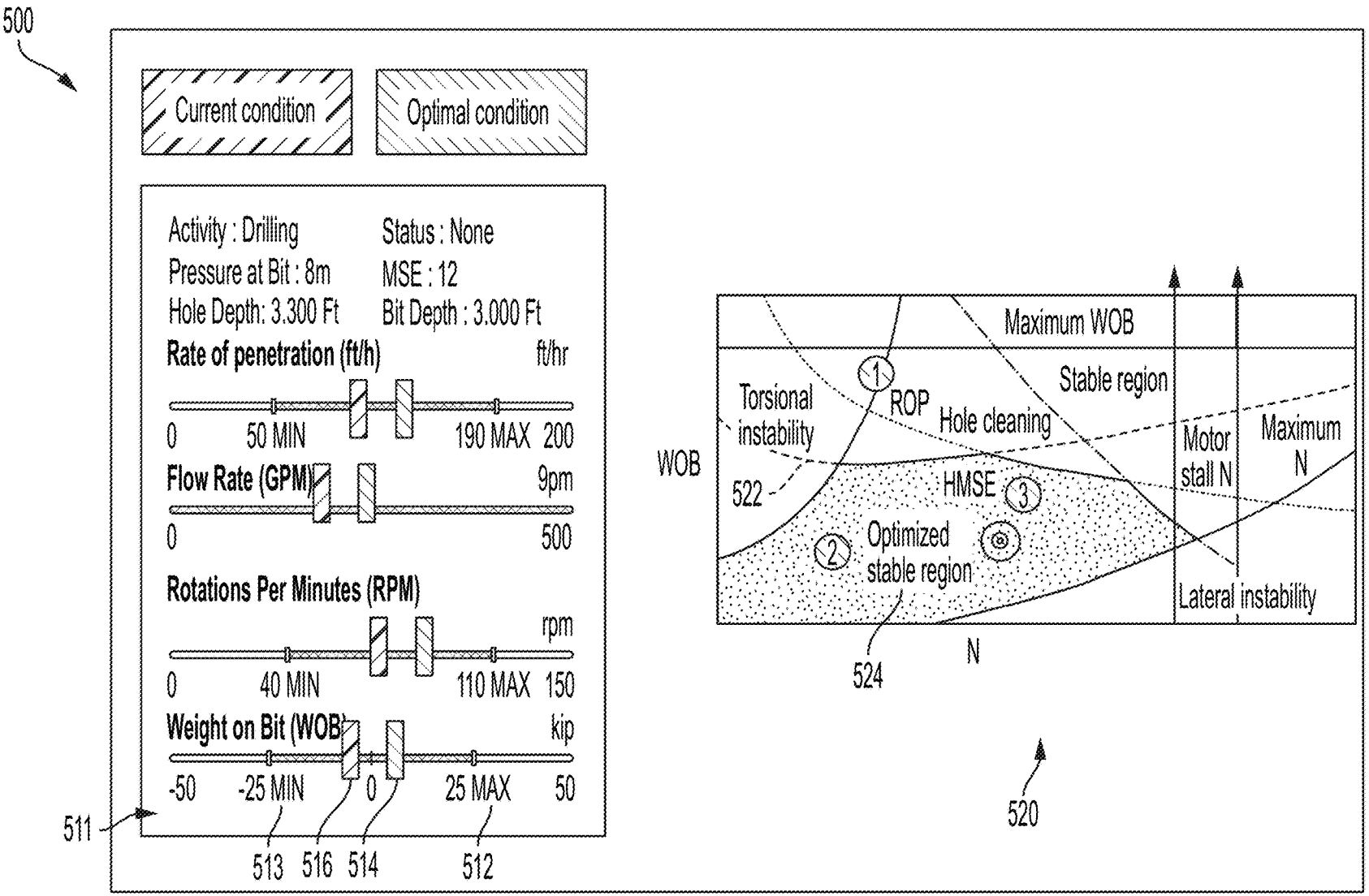
FIG. 5 is a graphical user interface usable for optimizing drilling parameters according to one example of the present disclosure.

FIG. 5 is a graphical user interface 500 that can be used for optimizing drilling parameters according to one example of the present disclosure. In some examples, the graphical user interface 500 can be used to provide drilling parameters that are optimized by the computing device 140, for example via the optimization model 314. The graphical user interface 500 can include a set of sliders 511 such that each slider 511 can correspond to one of the drilling parameters. Each slider 511 can include a minimum acceptable value 513 of the corresponding drilling parameter and a maximum acceptable value 512 of the corresponding drilling parameter. The computing device 140 can determine the minimum acceptable value 513 and the maximum acceptable value 512 using one or more software applications 312 that determine one or more constraints based on the input data 215 from the drilling operation. The software applications 312 can include one or more engineering models that can determine the minimum acceptable value 513, the maximum acceptable value 512, and a set of acceptable values between the minimum acceptable value 513 and the maximum acceptable value 512 for each drilling parameter based on a current state of the drilling operation. The slider 511 can display a current value 516 for each drilling parameter and an optimal value 514 for each drilling parameter. The slider 511 can be adjusted. For example, a user can manually adjust the slider 511 to select a desired drilling parameter value. In some examples, the computing device 140 can automatically adjust the slider 511 to select the optimal value 514 of the drilling parameter.

The graphical user interface 500 can include a plot 520 that can depict constraints 522 associated with the drilling parameters. In some examples, the plot 520 may illustrate a wellbore-drilling envelope for the drilling operation. The constraints 522 may form a stable region 524 of acceptable values for the drilling parameters. For example, the stable region 524 may include values of each drilling parameter that can be used for the drilling operation that may avoid any instabilities in the wellbore 100. The constraints 522 can be determined to prevent undesired drilling events. For example, the constraints 522 can include a maximum hydromechanical specific energy constraint, a maximum rate of penetration constraint, a torsional instability constraint, a lateral instability constraint, or any other suitable constraints 522. A user can interact with the graphical user interface 500 to adjust drilling parameters in substantially real-time. For example, the user can interact with a slider 511 to adjust the value of a drilling parameter in the wellbore drilling operation. For example, the user can interact with a weight-on-bit slider 511 to adjust the weight on the drill bit. The computing device 140 can substantially contemporaneously issue a command to the well tool to adjust the drilling parameter based on the value of the slider 511. In some examples, the computing device 140, without input from the user, can automatically transmit the command to the well tool to adjust the drilling parameters upon determining the optimal drilling parameter with respect to any suitable constraints.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

In some aspects, system, method, and non-transitory computer readable medium for optimizing drilling parameters for controlling a wellbore drilling operation are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processor; and a non-transitory computer-readable medium that includes instructions executable by the processor for causing the processor to perform operations comprising: receiving input data indicating a current state of a wellbore drilling operation; determining, by a plurality of software applications, a plurality of constraints associated with the wellbore drilling operation; optimizing, by an optimization model and using the input data and the plurality of constraints, a drilling parameter subject to the constraints associated with the wellbore drilling operation; and outputting the optimized drilling parameter for controlling the wellbore drilling operation.

Example 2 is the system of example 1, wherein the input data comprises: a current value for the drilling parameter; user-input corresponding to the drilling parameter; historical data associated with the wellbore drilling operation; and log data from a real-time feed associated with the wellbore drilling operation; and wherein the drilling parameter includes a rate of penetration, a weight-on-bit, a flow rate, or a number of rotations per minute.

Example 3 is the system of example 1, wherein instructions are further executable by the processor for causing the processor to perform operations comprising controlling, using the optimized drilling parameter, an automated rig of the wellbore drilling operation in an autonomous mode by issuing a command to a downhole tool for implementing the optimized drilling parameter.

Example 4 is the system of example 1, wherein the instructions are further executable by the processor for causing the processor to determine a performance indicator associated with the wellbore drilling operation, wherein the performance indicator includes a visual comparison of the current state of the wellbore drilling operation and a subsequent state of the wellbore drilling operation that includes the optimized drilling parameter.

Example 5 is the system of example 1, wherein instructions are further executable by the processor for causing the processor to perform operations comprising remotely transmitting the optimized drilling parameter to a control system of the drilling operation for automatically controlling the drilling operation.

Example 6 is the system of example 1, wherein the instructions are further executable by the processor for causing the processor to: determine, based on the constraints, a maximum acceptable value and a minimum acceptable value that define a range of stable values for the drilling parameter; and generate a graphical user interface displaying the maximum acceptable value, the minimum acceptable value, and a current value of each drilling parameter.

Example 7 is the system of any of examples 1 and 6, wherein the drilling parameter is adjustable via the graphical user interface, and wherein the graphical user interface further comprises: a first section comprising a plurality of interactive features that are adjustable for controlling the wellbore drilling operation, each interactive feature of the plurality of interactive features comprising: a maximum value corresponding to a first constraint of the plurality of constraints; a minimum value corresponding to a second constraint of the plurality of constraints; a range of values between the minimum value and the maximum value, the range of values defining a stable value region for a corresponding drilling parameter; and an interactive button for selecting a subsequent value of the corresponding drilling parameter; and a second section comprising a stability plot for displaying a plurality of curves corresponding to the plurality of constraints.

Example 8 is a method comprising: receiving input data indicating a current state of a wellbore drilling operation; determining, by a plurality of software applications, a plurality of constraints associated with the wellbore drilling operation; optimizing, by an optimization model and using the input data and the plurality of constraints, a drilling parameter subject to the constraints associated with the wellbore drilling operation; and outputting the optimized drilling parameter for controlling the wellbore drilling operation.

Example 9 is the method of example 8, wherein the input data comprises: a current value for the drilling parameter; user-input corresponding to the drilling parameter; historical data associated with the wellbore drilling operation; and log data from a real-time feed associated with the wellbore drilling operation; and wherein the drilling parameter includes a rate of penetration, a weight-on-bit, a flow rate, or a number of rotations per minute.

Example 10 is the method of example 8, further comprising controlling, using the optimized drilling parameter, an automated rig of the wellbore drilling operation in an autonomous mode by issuing a command to a downhole tool for implementing the optimized drilling parameter.

Example 11 is the method of example 8, further comprising determining a performance indicator associated with the wellbore drilling operation, wherein the performance indicator includes a visual comparison of the current state of the wellbore drilling operation and a subsequent state of the wellbore drilling operation that includes the optimized drilling parameter.

Example 12 is the method of example 8, further comprising remotely transmitting the optimized drilling parameter to a control system of the drilling operation for automatically controlling the drilling operation.

Example 13 is the method of example 8, further comprising: determining, based on the constraints, a maximum acceptable value and a minimum acceptable value that define a range of stable values for the drilling parameter; and generating a graphical user interface displaying the maximum acceptable value, the minimum acceptable value, and a current value of each drilling parameter.

Example 14 is the method of any of examples 8 and 13, further comprising adjusting the drilling parameter via the graphical user interface, and wherein generating the graphical user interface comprises: generating a first section comprising a plurality of interactive features for controlling the wellbore drilling operation, each interactive feature of the plurality of interactive features comprising: a maximum value corresponding to a first constraint of the plurality of constraints; a minimum value corresponding to a second constraint of the plurality of constraints; a range of values between the minimum value and the maximum value, the range of values defining a stable value region for a corresponding drilling parameter; and an interactive button for selecting a subsequent value of the corresponding drilling parameter; and generating a second section comprising a stability plot for displaying a plurality of curves corresponding to the plurality of constraints.

Example 15 is a non-transitory computer-readable medium that includes instructions executable by a processor for causing the processor to perform operations comprising: receiving input data indicating a current state of a wellbore drilling operation; determining, by a plurality of software applications, a plurality of constraints associated with the wellbore drilling operation; optimizing, by an optimization model and using the input data and the plurality of constraints, a drilling parameter subject to the constraints associated with the wellbore drilling operation; and outputting the optimized drilling parameter for controlling the wellbore drilling operation.

Example 16 is the non-transitory computer-readable medium of example wherein the input data comprises: a current value for the drilling parameter; user-input corresponding to the drilling parameter; historical data associated with the wellbore drilling operation; and log data from a real-time feed associated with the wellbore drilling operation; and wherein the drilling parameter includes a rate of penetration, a weight-on-bit, a flow rate, or a number of rotations per minute.

Example 17 is the non-transitory computer-readable medium of example wherein the operations further comprise controlling, using the optimized drilling parameter, an automated rig of the wellbore drilling operation in an autonomous mode by issuing a command to a downhole tool for implementing the optimized drilling parameter.

Example 18 is the non-transitory computer-readable medium of example wherein the operations further comprise determining a performance indicator associated with the wellbore drilling operation, wherein the performance indicator includes a visual comparison of the current state of the wellbore drilling operation and a subsequent state of the wellbore drilling operation that includes the optimized drilling parameter.

Example 19 is the non-transitory computer-readable medium of example wherein the operations further comprise: determining, based on the constraints, a maximum acceptable value and a minimum acceptable value that define a range of stable values for the drilling parameter; and generating a graphical user interface displaying the maximum acceptable value, the minimum acceptable value, and a current value of each drilling parameter.

Example 20 is the non-transitory computer-readable medium of any of examples 15 and 19, wherein the drilling parameter is adjustable via the graphical user interface, and wherein the graphical user interface further comprises: a first section comprising a plurality of interactive features that are adjustable for controlling the wellbore drilling operation, each interactive feature of the plurality of interactive features comprising: a maximum value corresponding to a first constraint of the plurality of constraints; a minimum value corresponding to a second constraint of the plurality of constraints; a range of values between the minimum value and the maximum value, the range of values defining a stable value region for a corresponding drilling parameter; and an interactive button for selecting a subsequent value of the corresponding drilling parameter; and a second section comprising a stability plot for displaying a plurality of curves corresponding to the plurality of constraints.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processor; and a non-transitory computer-readable medium that includes instructions executable by the processor for causing the processor to perform operations comprising:

receiving input data indicating a current state of a wellbore drilling operation;

determining, by a plurality of software applications, a plurality of constraints associated with the wellbore drilling operation by:

using a hydro-mechanical specific energy model to determine a first constraint of the plurality of constraints; or using an engineering model to determine a second constraint of the plurality of constraints;

determining, based on the plurality of constraints, an optimized window defined by a maximum acceptable value and a minimum acceptable value that define a range of stable values for a drilling parameter;

optimizing, by an optimization model and using the input data, the plurality of constraints, and the range of stable values, the drilling parameter subject to the constraints associated with the wellbore drilling operation; and controlling, using the optimized drilling parameter, an automated rig of the wellbore drilling operation in an autonomous mode by issuing a command to a downhole tool for implementing the optimized drilling parameter.

2. The system of claim 1, wherein the input data comprises:

a current value for the drilling parameter;

user-input corresponding to the drilling parameter;

historical data associated with the wellbore drilling operation; and log data from a real-time feed associated with the wellbore drilling operation; and wherein the drilling parameter includes a rate of penetration, a weight-on-bit, a flow rate, or a number of rotations per minute.

3. The system of claim 1, wherein the instructions are further executable by the processor for causing the processor to determine a performance indicator associated with the wellbore drilling operation, wherein the performance indicator includes a visual comparison of the current state of the wellbore drilling operation and a subsequent state of the wellbore drilling operation that includes the optimized drilling parameter.

4. The system of claim 1, wherein instructions are further executable by the processor for causing the processor to perform operations comprising remotely transmitting the optimized drilling parameter to a control system of the drilling operation for automatically controlling the drilling operation.

5. The system of claim 1, wherein the instructions are further executable by the processor for causing the processor to:

generate a graphical user interface displaying the maximum acceptable value, the minimum acceptable value, and a current value of each drilling parameter.

6. The system of claim 5, wherein the drilling parameter is adjustable via the graphical user interface, and wherein the graphical user interface further comprises:

a first section comprising a plurality of interactive features that are adjustable for controlling the wellbore drilling operation, each interactive feature of the plurality of interactive features comprising:

a maximum value corresponding to a first constraint of the plurality of constraints;

a minimum value corresponding to a second constraint of the plurality of constraints;

a range of values between the minimum value and the maximum value, the range of values defining a stable value region for a corresponding drilling parameter; and an interactive button for selecting a subsequent value of the corresponding drilling parameter; and a second section comprising a stability plot for displaying a plurality of curves corresponding to the plurality of constraints.

7. A method comprising:

receiving input data indicating a current state of a wellbore drilling operation;

determining, by a plurality of software applications, a plurality of constraints associated with the wellbore drilling operation by:

using a hydro-mechanical specific energy model to determine a first constraint of the plurality of constraints; or using an engineering model to determine a second constraint of the plurality of constraints;

determining, based on the plurality of constraints, an optimized window defined by a maximum acceptable value and a minimum acceptable value that define a range of stable values for a drilling parameter;

optimizing, by an optimization model, using the input data and the plurality of constraints, and the range of stable values, the drilling parameter subject to the constraints associated with the wellbore drilling operation; and controlling, using the optimized drilling parameter, an automated rig of the wellbore drilling operation in an autonomous mode by issuing a command to a downhole tool for implementing the optimized drilling parameter.

8. The method of claim 7, wherein the input data comprises:

a current value for the drilling parameter;

user-input corresponding to the drilling parameter;

historical data associated with the wellbore drilling operation; and log data from a real-time feed associated with the wellbore drilling operation; and wherein the drilling parameter includes a rate of penetration, a weight-on-bit, a flow rate, or a number of rotations per minute.

9. The method of claim 7, further comprising determining a performance indicator associated with the wellbore drilling operation, wherein the performance indicator includes a visual comparison of the current state of the wellbore drilling operation and a subsequent state of the wellbore drilling operation that includes the optimized drilling parameter.

10. The method of claim 7, further comprising remotely transmitting the optimized drilling parameter to a control system of the drilling operation for automatically controlling the drilling operation.

11. The method of claim 7, further comprising:

generating a graphical user interface displaying the maximum acceptable value, the minimum acceptable value, and a current value of each drilling parameter.

12. The method of claim 11, further comprising adjusting the drilling parameter via the graphical user interface, and wherein generating the graphical user interface comprises:

generating a first section comprising a plurality of interactive features for controlling the wellbore drilling operation, each interactive feature of the plurality of interactive features comprising:

a maximum value corresponding to a first constraint of the plurality of constraints;

a minimum value corresponding to a second constraint of the plurality of constraints;

a range of values between the minimum value and the maximum value, the range of values defining a stable value region for a corresponding drilling parameter; and an interactive button for selecting a subsequent value of the corresponding drilling parameter; and generating a second section comprising a stability plot for displaying a plurality of curves corresponding to the plurality of constraints.

13. A non-transitory computer-readable medium that includes instructions executable by a processor for causing the processor to perform operations comprising:

receiving input data indicating a current state of a wellbore drilling operation;

determining, by a plurality of software applications, a plurality of constraints associated with the wellbore drilling operation by:

using a hydro-mechanical specific energy model to determine a first constraint of the plurality of constraints; or using an engineering model to determine a second constraint of the plurality of constraints;

determining, based on the plurality of constraints, an optimized window defined by a maximum acceptable value and a minimum acceptable value that define a range of stable values for a drilling parameter;

optimizing, by an optimization model, using the input data and the plurality of constraints, and the range of stable values, the drilling parameter subject to the constraints associated with the wellbore drilling operation; and controlling, using the optimized drilling parameter, an automated rig of the wellbore drilling operation in an autonomous mode by issuing a command to a downhole tool for implementing the optimized drilling parameter.

14. The non-transitory computer-readable medium of claim 13, wherein the input data comprises:

a current value for the drilling parameter;

user-input corresponding to the drilling parameter;

historical data associated with the wellbore drilling operation; and log data from a real-time feed associated with the wellbore drilling operation; and wherein the drilling parameter includes a rate of penetration, a weight-on-bit, a flow rate, or a number of rotations per minute.

15. The non-transitory computer-readable medium of claim 13, wherein the operations further comprise determining a performance indicator associated with the wellbore drilling operation, wherein the performance indicator includes a visual comparison of the current state of the wellbore drilling operation and a subsequent state of the wellbore drilling operation that includes the optimized drilling parameter.

16. The non-transitory computer-readable medium of claim 13, wherein the operations further comprise:

generating a graphical user interface displaying the maximum acceptable value, the minimum acceptable value, and a current value of each drilling parameter.

17. The non-transitory computer-readable medium of claim 16, wherein the drilling parameter is adjustable via the graphical user interface, and wherein the graphical user interface further comprises:

a first section comprising a plurality of interactive features that are adjustable for controlling the wellbore drilling operation, each interactive feature of the plurality of interactive features comprising:

a maximum value corresponding to a first constraint of the plurality of constraints;

a minimum value corresponding to a second constraint of the plurality of constraints;

a range of values between the minimum value and the maximum value, the range of values defining a stable value region for a corresponding drilling parameter; and an interactive button for selecting a subsequent value of the corresponding drilling parameter; and a second section comprising a stability plot for displaying a plurality of curves corresponding to the plurality of constraints.

* * * * *